US006827317B1

(12) United States Patent
Maki Risaliti

(10) Patent No.: US 6,827,317 B1
(45) Date of Patent: Dec. 7, 2004

(54) BABY BOTTLE ACCESSORY

(76) Inventor: Tammy L. Maki Risaliti, 5929 Golden Eagle Cir., Palm Beach Gardens, FL (US) 33418

( * ) Notice: Subject to any disclaimer, the term of this patent is extended or adjusted under 35 U.S.C. 154(b) by 0 days.

(21) Appl. No.: 10/199,887

(22) Filed: Jul. 18, 2002

(51) Int. Cl.[7] ..... A47D 15/00; A61J 9/06
(52) U.S. Cl. ..... 248/102; 248/105
(58) Field of Search ..... 248/102, 103, 248/104, 105

(56) References Cited

U.S. PATENT DOCUMENTS

| | | | | | |
|---|---|---|---|---|---|
| D153,937 | S | * | 5/1949 | Graboi | D83/8 |
| 3,669,117 | A | * | 6/1972 | Herbst | 606/235 |
| 4,320,883 | A | * | 3/1982 | Bass | 248/104 |
| 4,809,938 | A | * | 3/1989 | Skinner et al. | 248/102 |
| D305,346 | S | * | 1/1990 | Roberts | D21/162 |
| 4,895,327 | A | * | 1/1990 | Malone et al. | 248/102 |
| 4,944,704 | A | * | 7/1990 | Grace | 446/74 |
| D314,432 | S | * | 2/1991 | Shaw | D24/48 |
| 5,072,843 | A | * | 12/1991 | James | 215/395 |
| D334,983 | S | * | 4/1993 | Nicholls | D24/198 |
| 5,217,192 | A | * | 6/1993 | Oktayuren | 248/102 |
| 5,624,090 | A | | 4/1997 | Gammelgaard | |
| 5,782,868 | A | * | 7/1998 | Moore et al. | 606/235 |
| D402,761 | S | * | 12/1998 | Jones | D24/199 |
| 5,871,184 | A | | 2/1999 | Kaopio | |
| D412,583 | S | * | 8/1999 | Miller | D24/199 |
| 5,979,843 | A | * | 11/1999 | Beck | 248/102 |
| 5,993,285 | A | * | 11/1999 | Sofia et al. | 446/327 |
| 6,003,821 | A | | 12/1999 | Fabian et al. | |
| 6,082,681 | A | | 7/2000 | Rand | |
| 6,443,800 | B1 | * | 9/2002 | Rice | 446/227 |
| 6,463,257 | B1 | * | 10/2002 | Wood | 434/308 |

OTHER PUBLICATIONS

US 2002/0129447, Dunn, Infant Blanket with Teether/ Pacifier, Sep. 2002.*

* cited by examiner

*Primary Examiner*—Korie Chan
*Assistant Examiner*—Amy J. Sterling

(57) ABSTRACT

A combination baby bottle accessory and teething device in the form of a stuffed animal having a centrally located aperture for holding of a baby bottle at a predetermined distance for purposes of feeding the infant while providing entertainment/distraction. The stuffed animal toy has a main body portion and at least one appendage extending therefrom, such as a representation of the ears, limbs or tail of the stuffed animal. At least one appendage is formed from a material suitable for baby teething. The stuffed animal toy includes representations of facial features thereon formed by embroidery on the fabric covering. The main body portion includes an aperture extending therethrough wherein the fabric covering is contiguous through the aperture and the aperture includes an elastic means wherein the aperture can be maintained in a closed position. The aperture is sized for securing a baby bottle in a fixed position whereby a baby bottle inserted in the aperture can be maintained in position by the elastic means during feeding and upon removal of the baby bottle can be used as a stuffed animal toy.

12 Claims, 2 Drawing Sheets

BABY BOTTLE ACCESSORY

FIELD OF THE INVENTION

This invention is related to bottle-feeding of infants, and in particular to a baby bottle accessory device for use during the feeding process.

BACKGROUND OF THE INVENTION

The feeding of infants can be a trying time for the parent or guardian, especially if the infant is inquisitive and easily distracted. The difficulties are typically due to the inability of the child to maintain the necessary attention span to complete a feeding cycle without interruption. However, most infants are typically inquisitive making the feeding cycle difficult for most parents and guardians of the infant.

At birth, vision is the least mature of the senses. Research has shown this area of the brain is not completely wired at birth. A newborn's eyes can track or follow movement, but only within a distance of 7–12 inches from the infant's face. By six months, the infant's vision is as clear as an adults. Providing interesting objects in the environment helps the brain's vision area develop normally. Neuroscientists have found that infant's focusing with both eyes helps fine-tune the connections among brain cells. With visual stimulation, better eye focus and clearer vision will gradually develop. Objects should not be placed too close to the infant's face as this tends to cause the infant's eyes to misalign in a "cross-eyed" manner, which is not advantageous for visual development.

Researchers have found that infants instinctively prefer to look at faces and representations of facial features. In order to provide a device which quickly attract the attention of an infant while feeding, it would be desirable to provide a toy having "friendly" facial features which can be attached to the baby bottle itself. It would also be desirable that such a toy be properly positioned within the infant's field of vision while feeding. What is lacking in the art is a stuffed animal accessory for an baby bottle which serves to attract the attention of the infant during the feeding process, and can also be used without a bottle as a conventional toy.

DESCRIPTION OF THE PRIOR ART

A number of patent have issued each which combined toy figures with infant feeding devices. For instance, U.S. Pat. No. 5,624,090 discloses an infant feeding system which provides a holder for a baby bottle, the holder being shaped as an animal. However, the holder is designed for simply securing a baby bottle in position when not in use and is not used while feeding.

U.S. Pat. No. 5,871,184 discloses a baby bottle holder in the shape of a small bear. The bottle is placed through the head of the bear for purposes of concealing the bottle. The bottle holder functions primarily and an insulation jacket for the bottle, and is not meant to be viewed by the infant while feeding. In the feeding position the bear is not recognizable by the infant, and as such it cannot captivate the infant's attention.

U.S. Pat. No. 6,082,681 discloses a baby bottle holder in the form of a large animal that can be placed on the tray table of a baby chair. The patent discloses the concealment of a bottle within a pouch placed upon the lap of animal. The head of the animal is placed at a distance from the infant's face to draw attention. This disclosure does not allow modification of the baby bottle position or allow the use of the holder as a toy. It is also undesirable to maintain the bottle in a fixed position proximate the infant's face without direct supervision.

A similar device is seen in U.S. Pat. No. 6,003,821 which discloses a decorative baby bottle holder in the shape of an animal including a means for securing the holder to a fixed item such as a crib rail. The holder provides for the concealment of the bottle wherein the body of the holder fits over a support arm to conceal the support as well as a portion of the infant's bottle. The holder positions the bottle in close proximity to the infant making it inappropriate for many applications. Also, the "face" of the toy is positioned too closely to the infant's face while feeding, and as a result the infant will not be able to focus on it properly.

SUMMARY OF THE INVENTION

Disclosed is a combination baby bottle accessory and teething device which comprises a stuffed animal toy having a fabric covering and a pliant filling therein which has a main body portion and at least one appendage extending therefrom which is formed from a material suitable for baby teething. In a preferred embodiment, two appendages formed from teething material are provided and preferably are a representation of the ears of the stuffed animal. The stuffed animal toy includes representations of facial features thereon which are formed by embroidery on the fabric covering. The main body portion includes an aperture extending therethrough such that the fabric covering is contiguous through the aperture. The aperture has a diameter sized to receive a baby bottle whereby the stuffed animal toy can be positioned on the baby bottle by sliding the baby bottle into the aperture. The aperture includes an elastic means which allows the stuffed animal toy to be positioned on the baby bottle in a fixed position. A pressure activated sound-making means can be disposed inside said stuffed animal toy. A fabric flap portion which includes indicia thereon can be fixedly attached to the stuffed animal toy. In a preferred embodiment, the fabric flap portion is a bib around the stuffed animal's "neck."

It is an objective of the invention to provide a baby bottle accessory in the form of a stuffed animal that can be positioned on the bottle during feeding, with distraction provided by proper position of the head of the stuffed animal at a distance that allows grasping by the infant, but at a such a distance so as not to cause the associated problems of close viewing of an object by an infant.

It is a further object of the invention to provide a baby bottle accessory in the form of a stuffed animal which includes appendages representing the "ears" of animal which are formed from a teething material.

Still another objective of the instant invention is to provide a baby bottle accessory that further operates as a conventional stuffed animal that can be left at close proximity of an infant or become an infant's "buddy" whereby at feeding time no strange object is placed before the infant.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
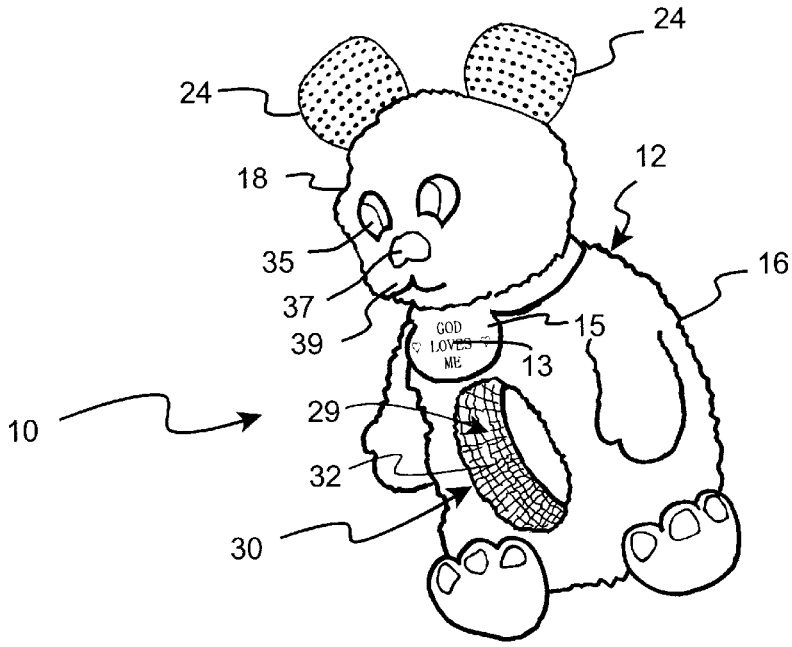
FIG. 1 a perspective view of a the baby bottle accessory according to a preferred embodiment of the invention.
Figure 2:
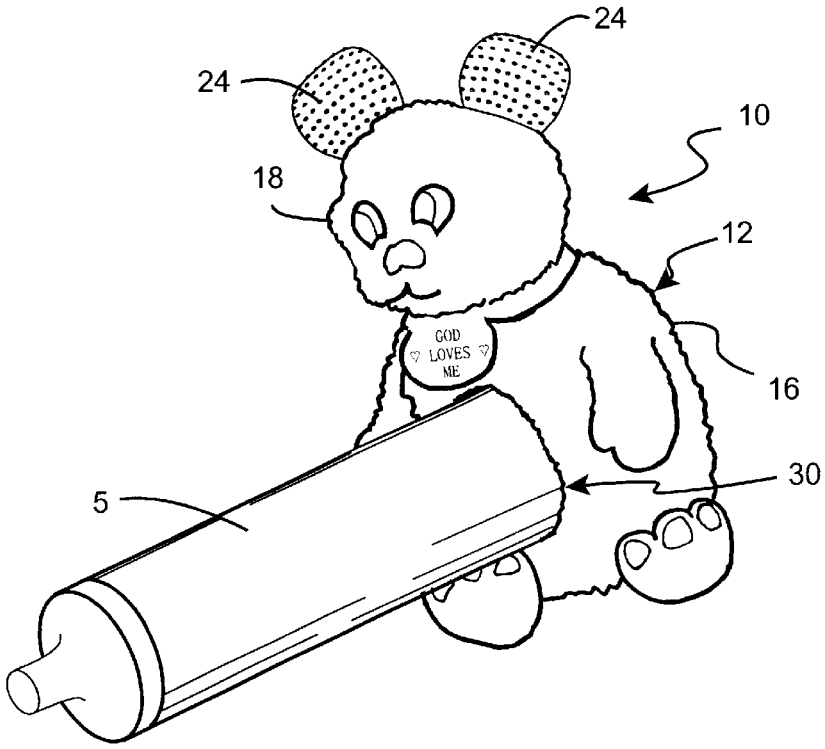
FIG. 2 illustrates the stuffed animal toy of FIG. 1 in which a baby bottle is shown inserted into the central aperture.

FIGS. 1 and 2 illustrate the stuffed animal toy 10 according to a preferred embodiment of the invention. The stuffed animal toy 10 of the invention has a first mode of use in which the toy 10 is suitable to be placed in the crib with the infant as a play toy (FIG. 1), and a second mode of operation as a baby bottle accessory for use during feeding of the infant (FIG. 2). The illustrated embodiment of the stuffed animal toy 10 is shown as a "teddy bear," however the stuffed animal toy 10 can be a toy representation of any type of animal as would be entertaining to a young child. The stuffed animal 10 has a fabric covering 12 which encases a pliant stuffing material (not shown). The fabric covering 12 can be any suitable type of fabric and can have any desired texture as may be appropriate for the type of animal being represented. The stuffed animal toy 10 is preferably constructed so as to be machine washable. The main body 16 can also include a pressure-activated sound making means, such as a "squeaking" device.

The stuffed animal 10 has a main body portion 16, and can include appendages extending therefrom representing limbs, tails, ears, etc. The main body portion 16 can be segmented to define a head portion 18. The general appearance and number of the appendages depends on the type of animal being represented. In the case of the illustrated embodiment, the stuffed animal toy 10 includes legs 22 and ear portions 24. The legs 22 are preferably constructed in the same manner as the main body portion 16, i.e. with the same fabric and stuffing material, and are either formed integrally with the main body 16 or are sewn into the seams of the main body 16 as separate pieces.

An aperture 30 extends through the main body 16 such that the fabric cover 12 is contiguous therethrough. The aperture 30 has a diameter which is approximately equal to that of a standard baby bottle to thus allow a baby bottle to be slidingly inserted through the aperture 30. FIG. 2 illustrates a baby bottle 5 inserted through the aperture 30. An elastic means 32 can be provided about the periphery of the aperture 30 which serves to maintain the stuffed animal 1O on the baby bottle 5. The elastic means 32 can include a plurality of elastic bands circumferentially positioned through the interior portion 29 of aperture 30. The elastic means 32 serves to secure the baby bottle in a fixed position.

It is an objective of the present invention that the stuffed animal 10, when placed on a baby bottle, attracts and captivates the attention of the infant. For this reason, the stuffed animal 10 is preferably positioned proximate the lower end of the baby bottle 5, as shown in FIG. 2. The length of a standard sized baby bottle is approximately 7 inches. Placing the stuffed animal 10 at the end of the baby bottle, at a distance of approximately 7 inches, ensures that the face of the stuffed animal is within the infant's field of focus. Placing an object too close to the face of the infant will tend to cause to infant to focus on the object in a "cross-eyed" fashion, which is not healthy for the development of visual coordination skills.

Figure 3A:
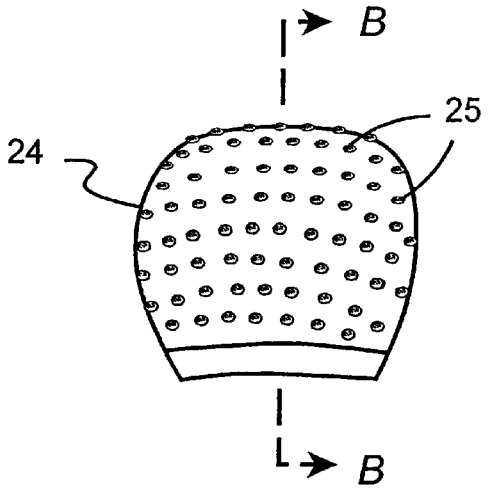
FIG. 3A is an illustration of a first embodiment of a appendage formed as a ear portion which is adapted to used for teething purposes.
Figure 3B:
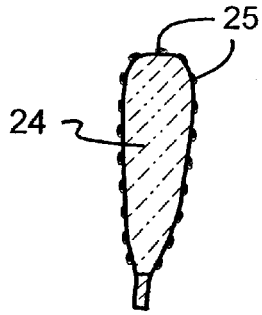
FIG. 3B is a cross-sectional view of the appendage shown in FIG. 3A taken along the lien B—B.
Figure 4A:
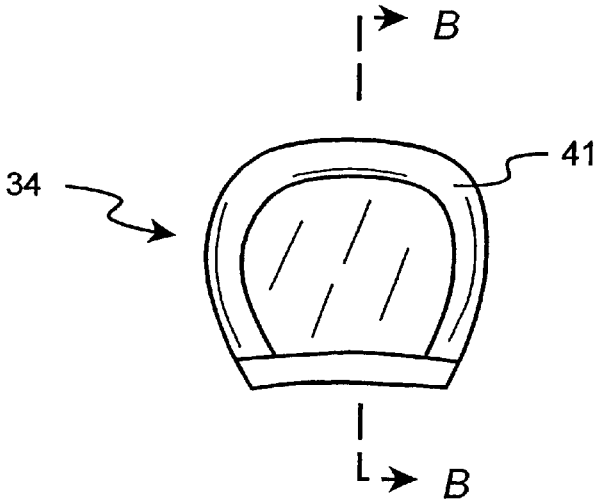
FIG. 4A is an illustration of a second embodiment of a appendage formed as an ear portion which is adapted to used for teething purposes.
Figure 4B:
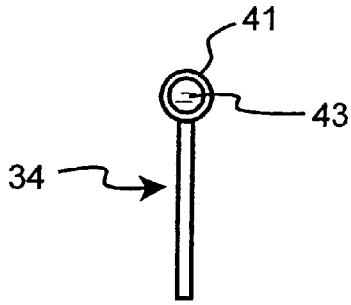
FIG. 4B is a cross-sectional view of the appendage shown in FIG. 3A taken along the line B—B.

The inventor has found that when an infant grasps a stuff animal toy that it is a natural tendency for an infant to chew on the extending appendages of the toy, particularly the ears. In order to positively utilize this tendency, it is an object of the invention that at least one of the appendages is formed from a pliable plastic material as would be used for a infant teething device. In the illustrated embodiment, the ear portions 24 are formed to function as teething aids. The ear portions 24 can thus be formed using any suitable materials and methods of construction to create an infant teething aid. In one embodiment shown in FIGS. 3A and 3B, the ear portions 24 are uniformly constructed from a resilient plastic material. The surface of the ear portions 24 can be textured with a plurality of protrusions 25 which serve to massage the gums of the infant. Another suitable method for construction of the ear portions 24 shown in a front view in FIG. 4A and cross-sectionally in FIG. 4B is to provide a tubular outer perimeter 41 on the upper edge of the ear portion 24 which contains liquid or gel substance 43. In each of these embodiments, the ear portions 24 can be stitched into the head portion 18.

The head portion 18 includes representations of facial features, such a the eyes 35, nose 37, and mouth 39. These facials features 35, 37 and 39 are formed by embroidery on the fabric cover12. In this way, the stuff animal toy 10 advantageously has no plastic parts which can become dislodged and pose a choking danger to the infant.

The stuffed animal toy 10 can be placed in the crib of an infant so that the toy 10 becomes a familiar trusted object for the infant. To use the stuffed animal toy 10 as a baby bottle accessory, a baby bottle 40 is inserted through the aperture 30 so that the nipple 41 is oriented to the front "face" of the stuffed animal toy 10, as shown in FIG. 2. The stuffed animal toy 10 serves to attract the attention of the infant so that the attention of the infant is immediately focused on the bottle when feeding is initiated. In practice, it has been found by the inventor that an infant will reflexively reach for the stuffed animal toy 10. This action is of great in the bottle feeding process because the infant's fascination with the stuffed animal toy 10 causes the infant to immediately commence feeding and stay focused on the bottle without interruption. When feeding, the infant can grasp the stuffed animal toy 10. When not being used as a baby bottle accessory, the stuffed animal toy 10 can be placed in the crib of the infant.

The main body 16 can also have any number of fabric flaps affixed thereto to portray different animal features such as tongues, tails, manes, fins, etc. In the preferred embodiment, the stuffed animal toy 10 includes a fabric flap 15 proximate to the head portion 16 as shown in FIGS. 1 and 2. The fabric flap 15 can be include any desired indicia 13, as shown.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. The combination stuffed animal toy and baby bottle holder, comprising a stuffed animal toy having a fabric covering, said stuffed animal toy having a head and a main body portion with at least one appendage extending therefrom wherein said at least one appendage is formed from pliant plastic suitable for baby teething, said head including representations of facial features thereon, including an aperture extending therethrough wherein said fabric covering is contiguous through said aperture; said aperture having a circumference including elastic bands sized to secure a baby bottle whereby said stuffed animal toy can be positioned on the baby bottle to prevent cross eyed focus.

2. The combination baby bottle accessory and teething device according to claim 1, wherein said at least one appendage is a representation of an ear of the stuffed animal.

3. The combination baby bottle accessory and teething device according to claim 1, further comprising a pressure activated sound-making means disposed inside said stuffed animal toy.

4. The combination stuffed animal toy and baby bottle holder according to claim 1, wherein said stuffed animal toy further comprises a fabric flap portion fixedly attached to said main body proximate said head [portion] wherein said fabric flap portion includes indicia thereon.

5. The combination stuffed animal toy and baby bottle accessory according to claim 1, wherein said appendage has an outer surface, said outer surface includes a plurality of protrusions extending therefrom.

6. The combination stuffed animal toy and baby bottle holder according to claim 1, wherein said at least one appendage comprises a hollow housing formed from a resilient plastic, said hollow housing contains a gel substance.

7. The combination stuffed animal toy and baby bottle holder according to claim 1, wherein said at least one appendage comprises a hollow housing formed from a resilient plastic, said hollow housing contains a liquid substance.

8. The combination stuffed animal toy and baby bottle holder according to claim 5, wherein said at least one appendage is a representation of an ear of the stuffed animal.

9. The combination stuffed animal toy and baby bottle holder according to claim 6, wherein said at least one appendage is a representation of an ear of the stuffed animal.

10. The combination stuffed animal toy and baby bottle holder according to claim 7, wherein said at least one appendage is a representation of an ear of the stuffed animal.

11. The combination stuffed animal toy and baby bottle holder according to claim 1, wherein said representations of facial features are formed by embroidery on said fabric covering.

12. The combination of a stuffed animal toy and baby bottle comprising a stuffed animal toy having a fabric covering, said stuffed animal toy having a head with a first ear and a second ear and a main body portion with at least one said ear extending therefrom wherein said at least one said ear comprises a hollow housing formed from a resilient plastic, said hollow housing containing a liquid substance, said head including representations of facial features thereon, said main body portion including an aperture extending therethrough wherein said fabric covering is contiguous through said aperture, said aperture having a circumference including elastic bands securing said baby bottle, said baby bottle having a first end fitted with a nipple and a second closed end, said stuffed toy animal secured to said baby bottle approximately 7 inches from said first end.

* * * * *